US007950958B2

(12) United States Patent
Mathews

(10) Patent No.: US 7,950,958 B2
(45) Date of Patent: May 31, 2011

(54) CONNECTOR HAVING CONDUCTIVE MEMBER AND METHOD OF USE THEREOF

(75) Inventor: Roger Mathews, Syracuse, NY (US)

(73) Assignee: John Messalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/941,709

(22) Filed: Nov. 8, 2010

(65) Prior Publication Data

US 2011/0053413 A1 Mar. 3, 2011

Related U.S. Application Data

(63) Continuation of application No. 12/397,087, filed on Mar. 3, 2009, now Pat. No. 7,828,595, which is a continuation of application No. 10/997,218, filed on Nov. 24, 2004, now abandoned.

(51) Int. Cl.
*H01R 9/05* (2006.01)

(52) U.S. Cl. ..... 439/578

(58) Field of Classification Search ..... 439/578–585, 439/63, 733.1, 944, 271, 98–99
See application file for complete search history.

(56) References Cited

U.S. PATENT DOCUMENTS

| | | | |
|---|---|---|---|
| 1,667,485 | A | 4/1928 | MacDonald |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |

(Continued)

FOREIGN PATENT DOCUMENTS

CA 2096710 A1 11/1994

(Continued)

OTHER PUBLICATIONS

Application No. EP05813878.5-2214/Patent No. 1815559. Response to Supplementary European Search Report dated Feb. 6, 2009. Response date Dec. 10, 2009. 15 pages.

(Continued)

*Primary Examiner* — Edwin A. Leon
(74) *Attorney, Agent, or Firm* — Schmeiser, Olsen & Watts, LLP

(57) ABSTRACT

A connector having a conductive member is provided, wherein the connector comprises a connector body capable of sealing and securing a coaxial cable, and further wherein the conductive member, such as an O-ring, physically seals the connector, electrically couples the connector and the coaxial cable, facilitates grounding through the connector, and renders an electromagnetic shield preventing ingress of unwanted environmental noise.

9 Claims, 6 Drawing Sheets

U.S. PATENT DOCUMENTS

| | | | |
|---|---|---|---|
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,710,005 | A | 1/1973 | French |
| 3,739,076 | A | 6/1973 | Schwartz |
| 3,744,007 | A | 7/1973 | Horak |
| 3,778,535 | A | 12/1973 | Forney, Jr. |
| 3,781,762 | A | 12/1973 | Quackenbush |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |

4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,471 A 8/1992 Verespej et al.
5,141,448 A 8/1992 Mattingly et al.
5,141,451 A 8/1992 Down
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hse
5,702,263 A 12/1997 Baumann et al.
5,722,856 A 3/1998 Fuchs et al.
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,053,777 A 4/2000 Boyle
6,089,903 A 7/2000 Stafford Gray et al.
6,089,912 A 7/2000 Tallis et al.
6,089,913 A 7/2000 Holliday
6,146,197 A 11/2000 Holliday et al.
6,152,753 A 11/2000 Johnson et al.
6,153,830 A 11/2000 Montena
6,210,222 B1 4/2001 Langham et al.
6,217,383 B1 4/2001 Holland et al.
6,239,359 B1 5/2001 Lilienthal, II et al.

| | | | | |
|---|---|---|---|---|
| 6,241,553 | B1 | 6/2001 | Hsia | |
| 6,261,126 | B1 | 7/2001 | Stirling | |
| 6,271,464 | B1 | 8/2001 | Cunningham | |
| 6,331,123 | B1 | 12/2001 | Rodrigues | |
| 6,332,815 | B1 | 12/2001 | Bruce | |
| 6,358,077 | B1 | 3/2002 | Young | |
| D458,904 | S | 6/2002 | Montena | |
| D460,739 | S | 7/2002 | Fox | |
| D460,740 | S | 7/2002 | Montena | |
| D460,946 | S | 7/2002 | Montena | |
| D460,947 | S | 7/2002 | Montena | |
| D460,948 | S | 7/2002 | Montena | |
| 6,422,900 | B1 | 7/2002 | Hogan | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| 6,468,100 | B1 | 10/2002 | Meyer et al. | |
| 6,491,546 | B1 | 12/2002 | Perry | |
| D468,696 | S | 1/2003 | Montena | |
| 6,506,083 | B1 | 1/2003 | Bickford et al. | |
| 6,530,807 | B2 | 3/2003 | Rodrigues et al. | |
| 6,540,531 | B2 | 4/2003 | Syed et al. | |
| 6,558,194 | B2 | 5/2003 | Montena | |
| 6,572,419 | B2 | 6/2003 | Feye-Homann | |
| 6,576,833 | B2 | 6/2003 | Covaro et al. | |
| 6,619,876 | B2 | 9/2003 | Vaitkus et al. | |
| 6,676,446 | B2 | 1/2004 | Montena | |
| 6,683,253 | B1 | 1/2004 | Lee | |
| 6,692,285 | B2 | 2/2004 | Islam | |
| 6,712,631 | B1 | 3/2004 | Youtsey | |
| 6,716,062 | B1 | 4/2004 | Palinkas et al. | |
| 6,733,337 | B2 | 5/2004 | Kodaira | |
| 6,767,248 | B1 | 7/2004 | Hung | |
| 6,786,767 | B1 | 9/2004 | Fuks et al. | |
| 6,790,081 | B2 | 9/2004 | Burris et al. | |
| 6,805,584 | B1 | 10/2004 | Chen | |
| 6,817,896 | B2 | 11/2004 | Derenthal | |
| 6,848,939 | B2 | 2/2005 | Stirling | |
| 6,848,940 | B2 | 2/2005 | Montena | |
| 6,884,115 | B2 | 4/2005 | Malloy | |
| 6,939,169 | B2 | 9/2005 | Islam et al. | |
| 6,971,912 | B2 | 12/2005 | Montena et al. | |
| 7,029,326 | B2 * | 4/2006 | Montena | 439/585 |
| 7,086,897 | B2 * | 8/2006 | Montena | 439/578 |
| 7,114,990 | B2 | 10/2006 | Bence et al. | |
| 7,118,416 | B2 | 10/2006 | Montena et al. | |
| 7,479,035 | B2 | 1/2009 | Bence et al. | |
| 7,507,117 | B2 | 3/2009 | Amidon | |
| 7,828,595 | B2 | 11/2010 | Mathews | |
| 7,833,053 | B2 | 11/2010 | Mathews | |
| 7,845,976 | B2 | 12/2010 | Mathews | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2006/0110977 | A1 | 5/2006 | Matthews | |
| 2009/0098770 | A1 | 4/2009 | Bence et al. | |

FOREIGN PATENT DOCUMENTS

| | | | |
|---|---|---|---|
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A1 | 8/1992 |
| GB | 2331634 | A | 5/1999 |
| JP | 3280369 | B2 | 5/2002 |
| WO | 0186756 | A1 | 11/2001 |
| WO | 2004013883 | A2 | 2/2004 |
| WO | 2006081141 | A1 | 8/2006 |

OTHER PUBLICATIONS

Application No. EP05813878.5-2214/Patent No. 1815559. Summons to Attend Oral Proceedings Pursuant to Rule 115(1) EPC on Oct. 28, 2010. Dated: Jun. 7, 2010. 12 pages.

*PCT International, Inc.*, v. *John Mezzalingua Associates, Inc.*; U.S. District Court District of Delaware (Wilmington); Civil Docket for Case #: 1:10-cv-00059-LPS. No decision yet.

*John Mezzalingua Associates, Inc.*, v. *PCT International, Inc.*; U.S. District Court Western District of Texas (San Antonio); Civil Docket for Case #: 5:09-cv-00410-WRF. No decision yet. Defendant's Answer to Plaintiff's First Amended Complaint, Affirmative Defenses and Counterclaims. pp. 1-53.

*John Mezzalingua Associates, Inc.*, v. *PCT International, Inc.*; U.S. District Court Western District of Texas (San Antonio); Civil Docket for Case #: 5:09-cv-00410-WRF. No decision yet. Expert Report of Barry Grossman (Redacted). 61 pages.

*John Mezzalingua Associates, Inc.*, v. *PCT International, Inc.*; U.S. District Court Western District of Texas (San Antonio); Civil Docket for Case #: 5:09-cv-00410-WRF. No decision yet. Defendant/Counterclaimant PCT International, Inc.'s First Supplemental Answers and Objections to Plaintiff/Counterclaim Defendant John Mezzalingua Associates, Inc. D/B/A PPC's Amended Second Set of Interrogatories (Nos. 4-17). pp. 1-11.

*John Mezzalingua Associates, Inc.*, v. *PCT International, Inc.*; U.S. District Court Western District of Texas (San Antonio); Civil Docket for Case #: 5:09-cv-00410-WRF. No decision yet. Defendant's Response and Objections to Plaintiff's Amended Second Set of Interrogatories (Nos. 4-17). pp. 1-20.

Supplementary European Search Report. EP05813878. Feb. 6, 2009. 11 pages.

* cited by examiner

CONNECTOR HAVING CONDUCTIVE MEMBER AND METHOD OF USE THEREOF

This is a continuation application claiming priority to application Ser. No. 12/397,087 filed on Mar. 3, 2009, which is a continuation application claiming priority to application Ser. No. 10/997,218, filed on Nov. 24, 2004.

BACKGROUND OF INVENTION

1. Technical Field

This invention relates generally to the field of connectors for coaxial cables. More particularly, this invention provides for a coaxial cable connector comprising at least one conductive member and a method of use thereof.

2. Related Art

Broadband communications have become an increasingly prevalent form of electromagnetic information exchange and coaxial cables are common conduits for transmission of broadband communications. Connectors for coaxial cables are typically connected onto complementary interface ports to electrically integrate coaxial cables to various electronic devices. In addition, connectors are often utilized to connect coaxial cables to various communications modifying equipment such as signal splitters, cable line extenders and cable network modules.

To help prevent the introduction of electromagnetic interference, coaxial cables are provided with an outer conductive shield. In an attempt to further screen ingress of environmental noise, typical connectors are generally configured to contact with and electrically extend the conductive shield of attached coaxial cables. Moreover, electromagnetic noise can be problematic when it is introduced via the connective juncture between an interface port and a connector. Such problematic noise interference is disruptive where an electromagnetic buffer is not provided by an adequate electrical and/or physical interface between the port and the connector. Weathering also creates interference problems when metallic components corrode, deteriorate or become galvanically incompatible thereby resulting in intermittent contact and poor electromagnetic shielding.

Accordingly, there is a need in the field of coaxial cable connectors for an improved connector design.

SUMMARY OF INVENTION

The present invention provides an apparatus for use with coaxial cable connections that offers improved reliability.

A first general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a connector body, a threaded nut, and a conductive seal, the conductive seal electrically coupling the connector body and the threaded nut.

A second general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a post, having a first end and a second end, the first end configured to be inserted into an end of the coaxial cable around the dielectric and under the conductive grounding shield thereof. Moreover, the connector comprises a connector body, operatively attached to the post, and a conductive member, located proximate the second end of the post, wherein the conductive member facilitates grounding of the coaxial cable.

A third general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a connector body, having a first end and a second end, said first end configured to deformably compress against and seal a received coaxial cable, a post, operatively attached to said connector body, a threaded nut, operatively attached to said post, and a conductive member, located proximate the second end of the connector body, wherein the conductive member completes a shield preventing ingress of electromagnetic noise into the connector.

A fourth general aspect of the invention provides a connector for coupling an end of a coaxial cable, the coaxial cable having a center conductor surrounded by a dielectric, the dielectric being surrounded by a conductive grounding shield, the conductive grounding shield being surrounded by a protective outer jacket, said connector comprising a connector body a threaded nut, and means for conductively sealing and electrically coupling the connector body and the threaded nut.

A fifth general aspect of the invention provides a method for grounding a coaxial cable through a connector, the coaxial cable having a center conductor surrounded by a dielectric, the dielectric being surrounded by a conductive grounding shield, the conductive grounding shield being surrounded by a protective outer jacket, said method comprising providing a connector, wherein the connector includes a connector body, a post having a first end and a second end, and a conductive member located proximate the second end of said post, fixedly attaching the coaxial cable to the connector, and advancing the connector onto an interface port until a surface of the interface port mates with the conductive member facilitating grounding through the connector.

A sixth general aspect of the invention provides for a method for electrically coupling a coaxial cable and a connector, the coaxial cable having a center conductor surrounded by a dielectric, the dielectric being surrounded by a conductive grounding shield, the conductive grounding shield being surrounded by a protective outer jacket, said method comprising providing a connector, wherein the connector includes a connector body, a threaded nut, and a conductive member electrically coupling and physically sealing the connector body and the threaded nut, fixedly attaching the coaxial cable to the connector, and completing an electromagnetic shield by threading the nut onto a conductive interface port.

The foregoing and other features of the invention will be apparent from the following more particular description of various embodiments of the invention.

BRIEF DESCRIPTION OF THE DRAWINGS

Some of the embodiments of this invention will be described in detail, with reference to the following figures, wherein like designations denote like members, wherein.

DETAILED DESCRIPTION OF THE INVENTION

Figure 1:
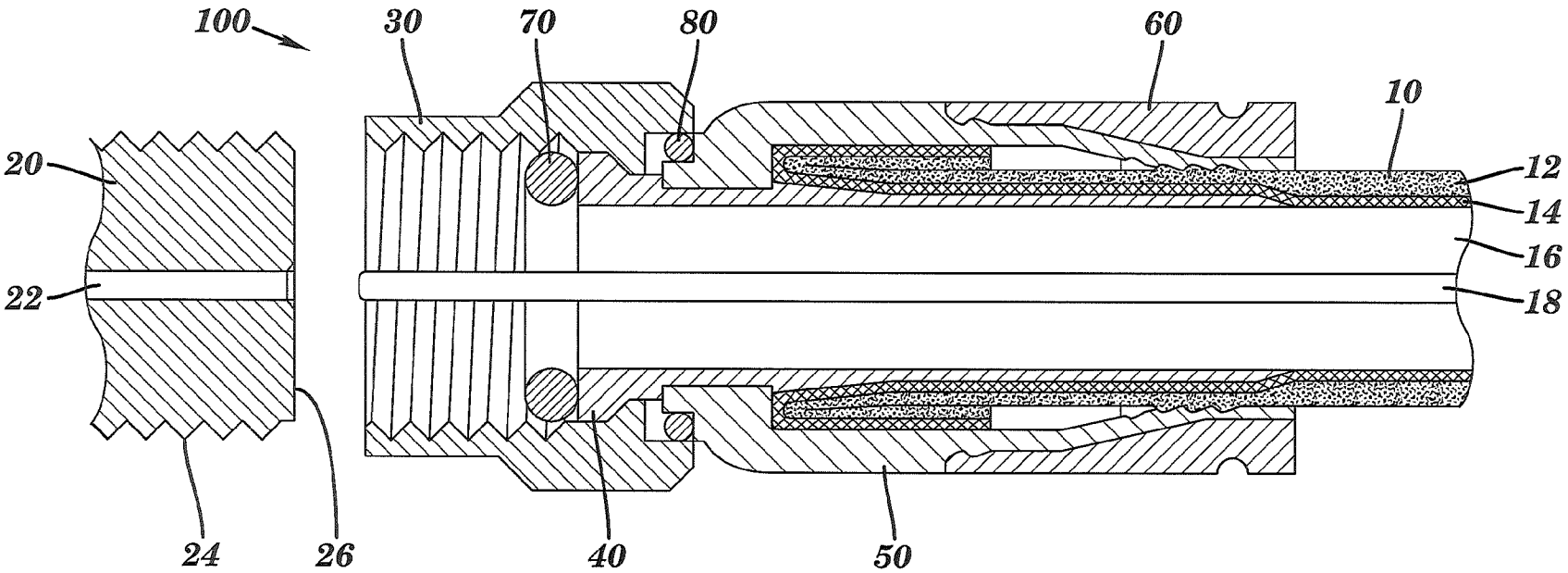
FIG. 1 depicts a sectional side view of an embodiment of an embodiment of a connector, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts one embodiment of a connector 100. The connector 100 may include a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may also include a coaxial cable interface port 20. The coaxial cable interface port 20 includes a conductive receptacle 22 for receiving a portion of a coaxial cable center conductor 18 sufficient to make adequate electrical contact. The coaxial cable interface port 20 may further comprise a threaded exterior surface 24. Although, various embodiment may employ a smooth as opposed to threaded exterior surface. In addition, the coaxial cable interface port 20 may comprise a mating edge 26. It should be recognized that the radial thickness and/or the length of the coaxial cable interface port 20 and/or the conductive receptacle 22 may vary based upon generally recognized parameters corresponding to broadband communication standards and/or equipment. Moreover, the pitch and height of threads which may be formed upon the threaded exterior surface 24 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 electrical interface with a connector 100. For example, the threaded exterior surface may be fabricated from a conductive material, while the material comprising the mating edge 26 may be non-conductive or vise versa. However, the conductive receptacle 22 should be formed of a conductive material. Further still, it will be understood by those of ordinary skill that the interface port 20 may be embodied by a connective interface component of a communications modifying device such as a signal splitter, a cable line extender, a cable network module and/or the like.

Referring still further to FIG. 1, an embodiment of the connector 100 may further comprise a threaded nut 30, a post 40, a connector body 50, a fastener member 60, a mating edge conductive member such as O-ring 70, and/or a connector body conductive member, such as O-ring 80, and means for conductively sealing and electrically coupling the connector body 50 and threaded nut 30. The means for conductively sealing and electrically coupling the connector body 50 and threaded nut 30 is the employment of the connector body conductive member 80 positioned in a location so as to make a physical seal and effectuate electrical contact between the connector body 50 and threaded nut 30.

Figure 2:
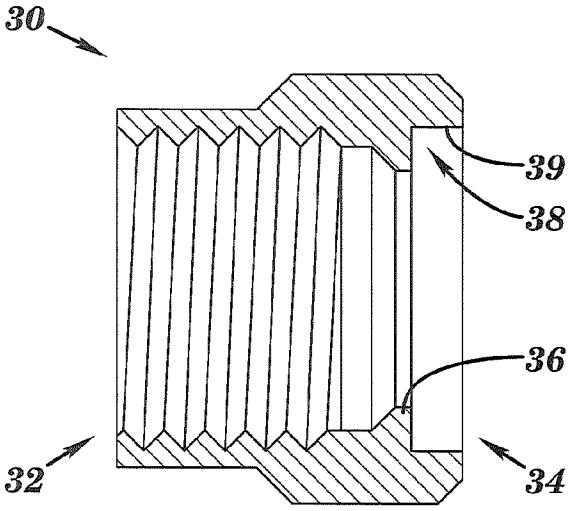
FIG. 2 depicts a sectional side view of an embodiment of a threaded nut, in accordance with the present invention.

With additional reference to the drawings, FIG. 2 depicts a sectional side view of an embodiment of a threaded nut 30 having a first end 32 and opposing second end 34. The threaded nut 30 may comprise an internal lip 36 located proximate the second end 34 and configured to hinder axial movement of the post 40 (shown in FIG. 1). Furthermore, the threaded nut 30 may comprise a cavity 38 extending axially from the edge of second end 34 and partial defined and bounded by the internal lip 36. The cavity 38 may also be partially defined and bounded by an outer internal wall 39. The threaded nut 30 may be formed of conductive materials facilitating grounding through the nut. Accordingly the nut 30 may be configured to extend an electromagnetic buffer by electrically contacting conductive surfaces of an interface port 20 when a connector 100 (shown in FIG. 1) is advanced onto the port 20. In addition, the threaded nut 30 may be formed of non-conductive material and function only to physically secure and advance a connector 100 onto an interface port 20. Moreover, the threaded nut 30 may be formed of both conductive and non-conductive materials. For example the internal lip 36 may be formed of a polymer, while the remainder of the nut 30 may be comprised of a metal or other conductive material. In addition, the threaded nut 30 may be formed of metals or polymers or other materials that would facilitate a rigidly formed body. Manufacture of the threaded nut 30 may include casting, extruding, cutting, turning, tapping, drilling, injection molding, blow molding, or other fabrication methods that may provide efficient production of the component.

Figure 3:
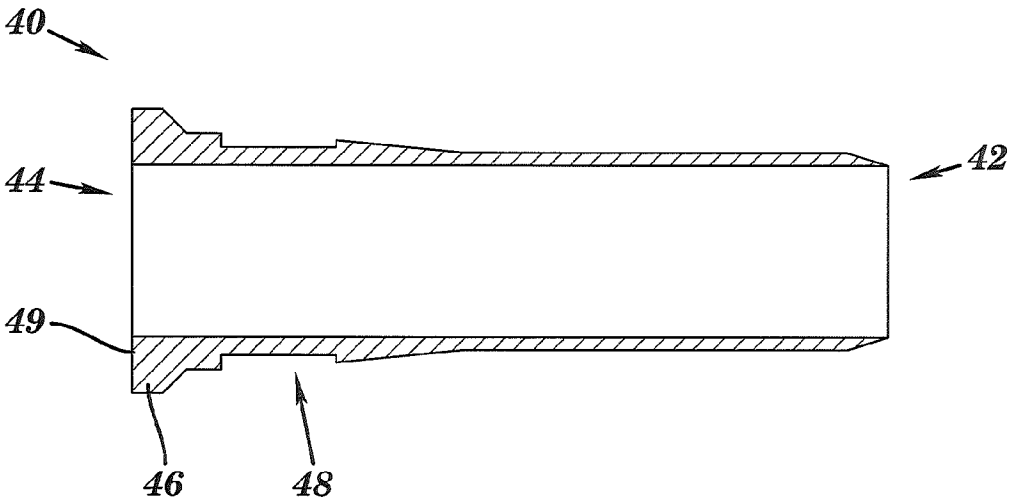
FIG. 3 depicts a sectional side view of an embodiment of a post, in accordance with the present invention.

With further reference to the drawings, FIG. 3 depicts a sectional side view of an embodiment of a post 40 in accordance with the present invention. The post 40 may comprise a first end 42 and opposing second end 44. Furthermore, the post 40 may comprise a flange 46 operatively configured to contact internal lip 36 of threaded nut 30 (shown in FIG. 2) thereby facilitating the prevention of axial movement of the post beyond the contacted internal lip 36. Further still, an embodiment of the post 40 may include a surface feature 48 such as a shallow recess, detent, cut, slot, or trough. Additionally, the post 40 may include a mating edge 49. The mating edge 49 may be configured to make physical and/or electrical contact with an interface port 20 or mating edge member or O-ring 70 (shown in FIG. 1). The post 40 should be formed such that portions of a prepared coaxial cable 10 including the dielectric 16 and center conductor 18 (shown in FIG. 1) may pass axially into the first end 42 and/or through the body of the post 40. Moreover, the post 40 should be dimensioned such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14 substantial physical and/or electrical contact with the shield 14 may be accomplished thereby facilitating grounding through the post 40. The post 40 may be formed of metals or other conductive materials that would facilitate a rigidly formed body. In addition, the post 40, may also be formed of non-conductive materials such as polymers or composites that facilitate a rigidly formed body. In further addition, the post may be formed of a combination of both conductive and non-conductive materials. For example, a metal coating or layer may be applied to a polymer of other non-conductive material. Manufacture of the post 40 may include casting, extruding, cutting, turning, drilling, injection molding, spraying, blow molding, or other fabrication methods that may provide efficient production of the component.

Figure 4:
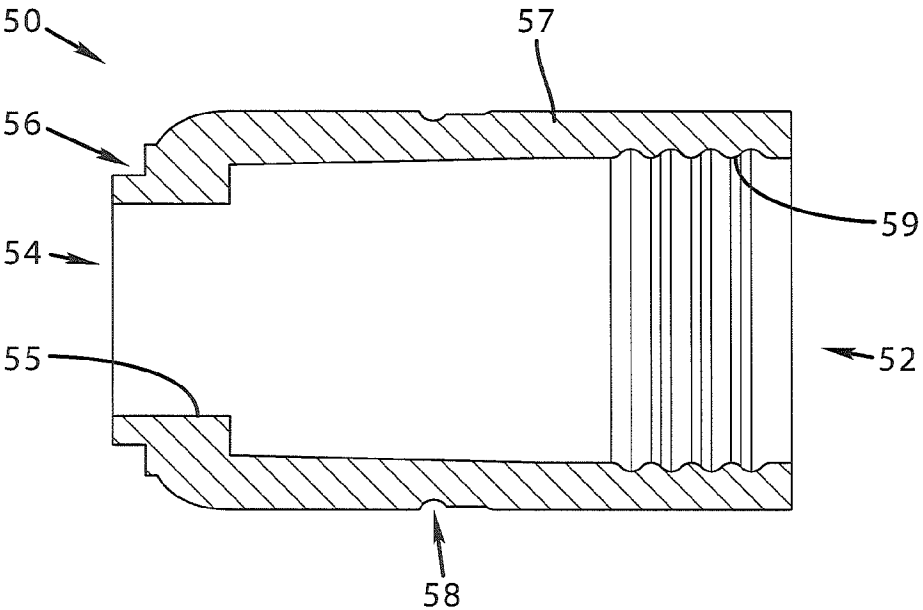
FIG. 4 depicts a sectional side view of an embodiment of a connector body, in accordance with the present invention.

With continued reference to the drawings, FIG. 4 depicts a sectional side view of a connector body 50. The connector body 50 may comprise a first end 52 and opposing second end 54. Moreover, the connector body may include an internal annular lip 55 configured to mate and achieve purchase with the surface feature 48 of post 40 (shown in FIG. 3). In addition, the connector body 50 may include an outer annular recess 56 located proximate the second end 54. Furthermore, the connector body may include a semi-rigid, yet compliant outer surface 57, wherein the outer surface 57 may include an annular detent 58. The outer surface 57 may be configured to form an annular seal when the first end 52 is deformably compressed against a received coaxial cable 10 by a fastener member 60 (shown in FIG. 1). Further still, the connector body 50 may include internal surface features 59, such as annular serrations formed proximate the first end 52 of the connector body 50 and configured to enhance frictional restraint and gripping of an inserted and received coaxial cable 10. The connector body 50 may be formed of materials such as, polymers, bendable metals or composite materials that facilitate a semi-rigid, yet compliant outer surface 57. Further, the connector body 50 may be formed of conductive or non-conductive materials or a combination thereof. Manufacture of the connector body 50 may include casting, extruding, cutting, turning, drilling, injection molding, spraying, blow molding, or other fabrication methods that may provide efficient production of the component.

Figure 5:
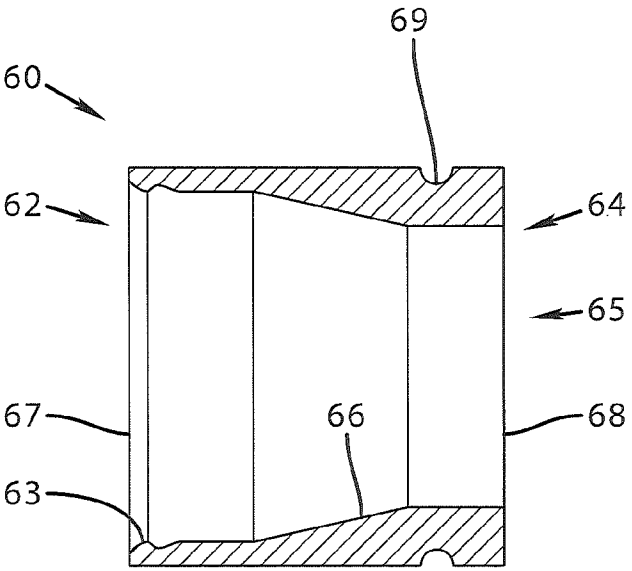
FIG. 5 depicts a sectional side view of an embodiment of a fastener member, in accordance with the present invention.

Referring further to the drawings, FIG. 5 depicts a sectional side view of an embodiment of a fastener member 60 in accordance with the present invention. The fastener member 60 may have a first end 62 and opposing second end 64. In addition, the fastener member 60 may include an internal annular protrusion 63 located proximate the first end 62 of the fastener member 60 and configured to mate and achieve purchase with the annular detent 58 on the outer surface 57 of connector body 50 (shown in FIG. 4). Moreover, the fastener member 60 may comprise a central passageway 65 defined between the first end 62 and second end 64 and extending axially through the fastener member 60. The central passageway 65 may comprise a ramped surface 66 which may be positioned between a first opening or inner bore 67 having a first diameter positioned proximate with the first end 62 of the fastener member 60 and a second opening or inner bore 68 having a second diameter positioned proximate with the second end 64 of the fastener member 60. The ramped surface 66 may act to deformably compress the outer surface 57 of a connector body 50 when the fastener member 60 is operated to secure a coaxial cable 10 (shown in FIG. 1). Additionally, the fastener member 60 may comprise an exterior surface feature 69 positioned proximate with the second end 64 of the fastener member 60. The surface feature 69 may facilitate gripping of the fastener member 60 during operation of the connector 100 (see FIG. 1). Although the surface feature is shown as a annular detent, it may have various shapes and sizes such as a ridge, notch, protrusion, knurling, or other friction or gripping type arrangements. It should be recognized, by those skilled in the requisite art, that the fastener member 60 may be formed of rigid materials such as metals, polymers, composites and the like. Furthermore, the fastener member 60 may be manufactured via casting, extruding, cutting, turning, drilling, injection molding, spraying, blow molding, or other fabrication methods that may provide efficient production of the component.

Figure 6:
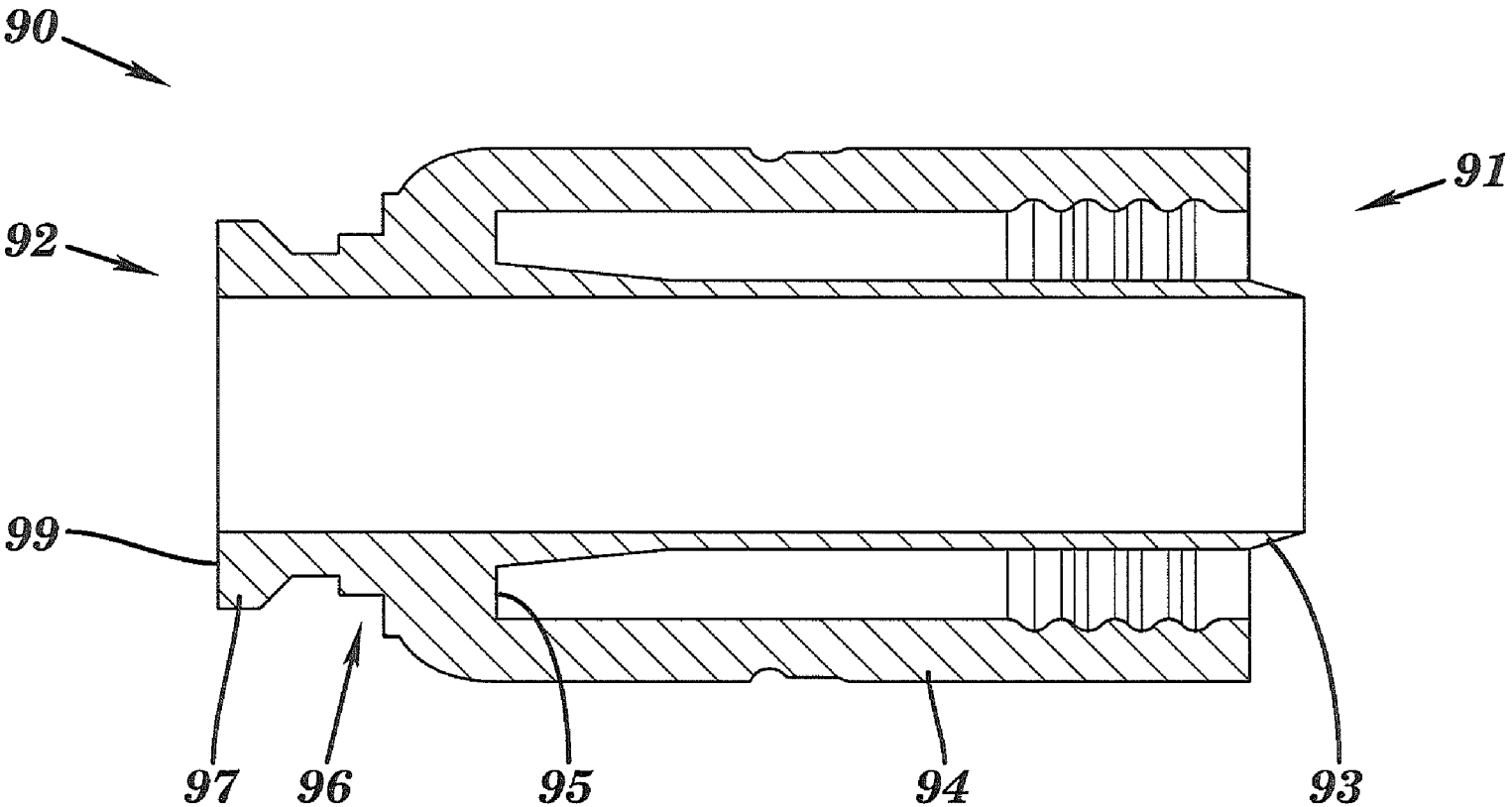
FIG. 6 depicts a sectional side view of an embodiment of a connector body having an integral post, in accordance with the present invention.

Referring still further to the drawings, FIG. 6 depicts a sectional side view of an embodiment of an integral post connector body 90 in accordance with the present invention. The integral post connector body 90 may have a first end 91 and opposing second end 92. The integral post connector body 90 physically and functionally integrates post and connector body components of an embodied connector 100 (shown in FIG. 1). Accordingly, the integral post connector body 90 includes a post member 93. The post member 93 may render connector operability similar to the functionality of post 40 (shown in FIG. 3). For example, the post member 93 of integral post connector body 90 may include a mating edge 99 configured to make physical and/or electrical contact with an interface port 20 or mating edge member or O-ring 70 (shown in FIG. 1). The post member 93 of integral should be formed such that portions of a prepared coaxial cable 10 including the dielectric 16 and center conductor 18 (shown in FIG. 1) may pass axially into the first end 91 and/or through the post member 93. Moreover, the post member 93 should be dimensioned such that a portion of the post member 93 may be inserted into an end of the prepared coaxial cable 10, around the dielectric 16 and under the protective outer jacket 12 and conductive grounding shield 14. Further, the integral post connector body 90 includes an outer connector body surface 94. The outer connector body surface 94 may render connector 100 operability similar to the functionality of connector body 50 (shown in FIG. 4). Hence, outer connector body surface 94 should be semi-rigid, yet compliant. The outer connector body surface 94 may be configured to form an annular seal when compressed against a coaxial cable 10 by a fastener member 60 (shown in FIG. 1). In addition, the integral post connector body 90 may include an interior wall 95. The interior wall 95 may be configured as an unbroken surface between the post member 93 and outer connector body surface 94 of integral post connector body 90 and may provide additional contact points for a conductive grounding shield 14 of a coaxial cable 10. Furthermore, the integral post connector body 90 may include an outer recess formed proximate the second end 92. Further still, the integral post connector body 90 may comprise a flange 97 located proximate the second end 92 and operatively configured to contact internal lip 36 of threaded nut 30 (shown in FIG. 2) thereby facilitating the prevention of axial movement of the integral post connector body 90 with respect to the threaded nut 30. The integral post connector body 90 may be formed of materials such as, polymers, bendable metals or composite materials that facilitate a semi-rigid, yet compliant outer connector body surface 94. Additionally, the integral post connector body 90 may be formed of conductive or non-conductive materials or a combination thereof. Manufacture of the integral post connector body 90 may include casting, extruding, cutting, turning, drilling, injection molding, spraying, blow molding, or other fabrication methods that may provide efficient production of the component.

Figure 7:
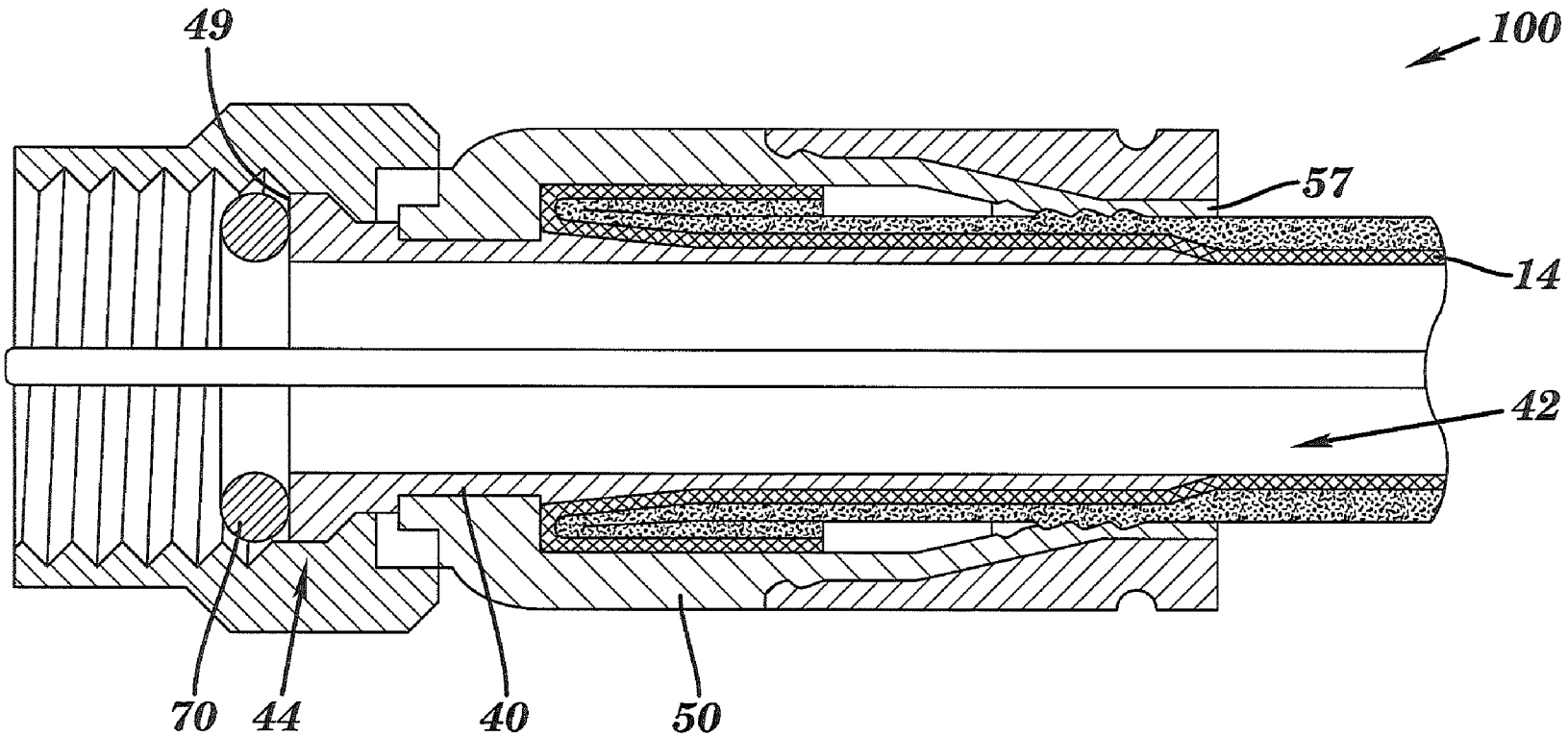
FIG. 7 depicts a sectional side view of an embodiment of a connector configured with a conductive member proximate a second end of a post, in accordance with the present invention.

With continued reference to the drawings, FIG. 7 depicts a sectional side view of an embodiment of a connector 100 configured with a mating edge conductive member 70 proximate a second end 44 of a post 40, in accordance with the present invention. The mating edge conductive member 70 should be formed of a conductive material. Such materials may include, but are not limited to conductive polymers, plastics, conductive elastomers, elastomeric mixtures, composite materials having conductive properties, soft metals, conductive rubber, and/or the like and/or any workable combination thereof. The mating edge conductive member 70 may comprise a substantially circinate torus or toroid structure adapted to fit within the internal threaded portion of threaded nut 30 such that the mating edge conductive member 70 may make contact with and/or reside continuous with a mating edge 49 of a post 40 when operatively attached to post 40 of connector 100. For example, one embodiment of the mating edge conductive member 70 may be an O-ring. The mating edge conductive member 70 may facilitate an annular seal between the threaded nut 30 and post 40 thereby providing a physical barrier to unwanted ingress of moisture and/or other environmental contaminates. Moreover, the mating edge conductive member 70 may facilitate electrical coupling of the post 40 and threaded nut 30 by extending therebetween an unbroken electrical circuit. In addition, the mating edge conductive member 70 may facilitate grounding of the connector 100, and attached coaxial cable (shown in FIG. 1), by extending the electrical connection between the post 40 and the threaded nut 30. Furthermore, the mating edge conductive member 70 may effectuate a buffer preventing ingress of electromagnetic noise between the threaded nut 30 and the post 40. The mating edge conductive member or O-ring 70 may be provided to users in an assembled position proximate the second end 44 of post 40, or users may themselves insert the mating edge conductive O-ring 70 into position prior to installation on an interface port 20 (shown in FIG. 1). Those skilled in the art would appreciate that the mating edge conductive member 70 may be fabricated by extruding, coating, molding, injecting, cutting, turning, elastomeric batch processing, vulcanizing, mixing, stamping, casting, and/or the like and/or any combination thereof in order to provide efficient production of the component.

Figure 8:
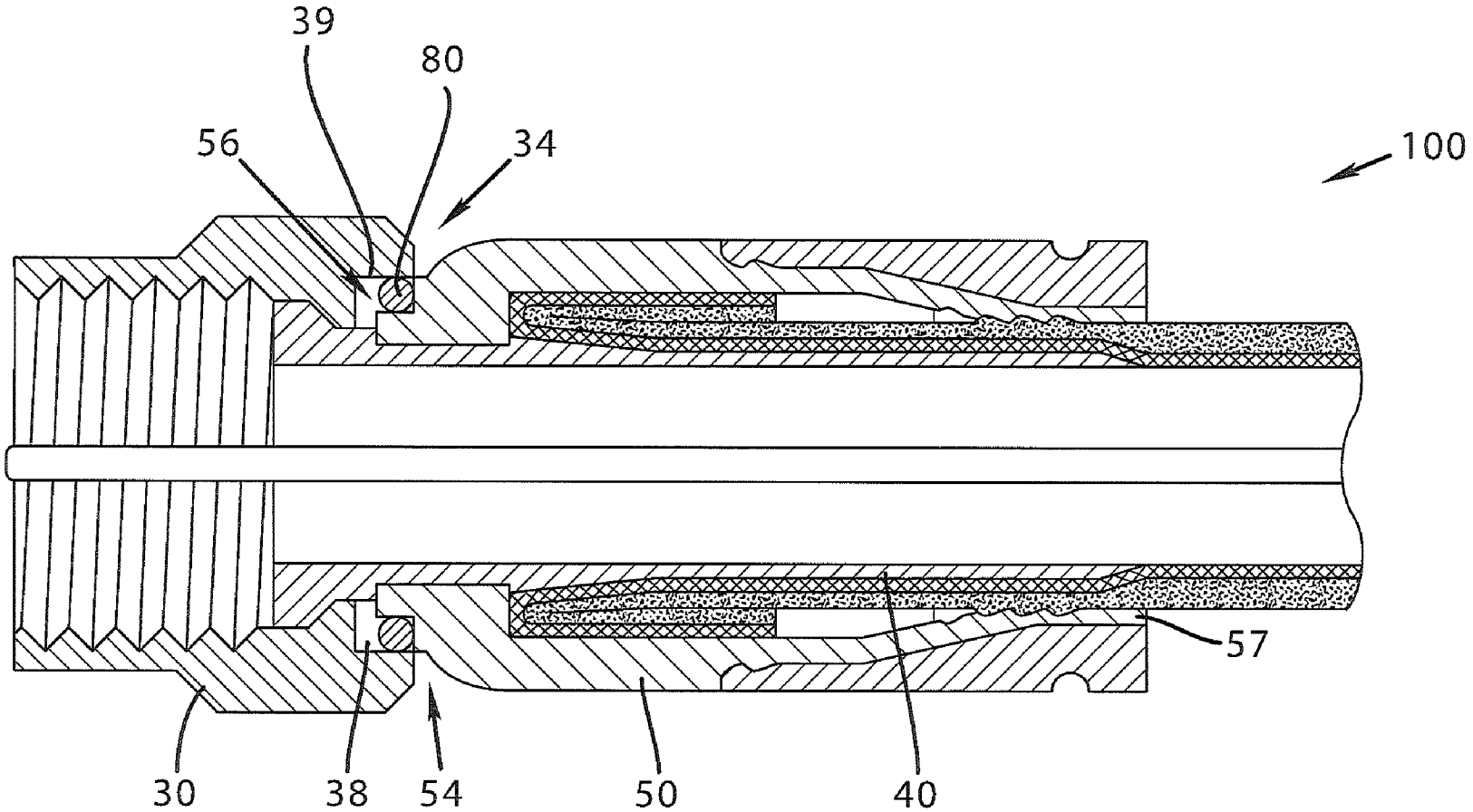
FIG. 8 depicts a sectional side view of an embodiment of a connector configured with a conductive member proximate a second end of a connector body, in accordance with the present invention.

With still further continued reference to the drawings, FIG. 8 depicts a sectional side view of an embodiment of a connector 100 configured with a connector body conductive member 80 proximate a second end 54 of a connector body 50, in accordance with the present invention. The connector body conductive member 80 should be formed of a conductive material. Such materials may include, but are not limited to conductive polymers, plastics, elastomeric mixtures, composite materials having conductive properties, soft metals, conductive rubber, and/or the like and/or any workable combination thereof. The connector body conductive member 80 may comprise a substantially circinate torus or toroid structure, or other ring-like structure. For example, an embodiment of the connector body conductive member 80 may be an O-ring configured to cooperate with the annular recess 56 proximate the second end 54 of connector body 50 and the cavity 38 extending axially from the edge of second end 34 and partially defined and bounded by an outer internal wall 39 of threaded nut 30 such that the connector body conductive O-ring 80 may make contact with and/or reside contiguous with the annular recess 56 of connector body 50 and outer internal wall 39 of threaded nut 30 when operatively attached to post 40 of connector 100. The connector body conductive member 80 may facilitate an annular seal between the threaded nut 30 and connector body 50 thereby providing a physical barrier to unwanted ingress of moisture and/or other environmental contaminates. Moreover, the connector body conductive member 80 may facilitate electrical coupling of the connector body 50 and threaded nut 30 by extending therebetween an unbroken electrical circuit. In addition, the connector body conductive member 80 may facilitate grounding of the connector 100, and attached coaxial cable (shown in FIG. 1), by extending the electrical connection between the connector body 50 and the threaded nut 30. Furthermore, the connector body conductive member 80 may effectuate a buffer preventing ingress of electromagnetic noise between the threaded nut 30 and the connector body 50. It should be recognized by those skilled in the relevant art that the connector body conductive member 80, like the mating edge conductive member 70, may be manufactured by extruding, coating, molding, injecting, cutting, turning, elastomeric batch processing, vulcanizing, mixing, stamping, casting, and/or the like and/or any combination thereof in order to provide efficient production of the component.

With reference to FIGS. 1 and 6-8, either or both of the mating edge conductive member or O-ring 70 and connector body conductive member or O-ring 80 may be utilized in conjunction with an integral post connector body 90. For example, the mating edge conductive member 70 may be inserted within a threaded nut 30 such that it contacts the mating edge 99 of integral post connector body 90 as implemented in an embodiment of connector 100. By further example, the connector body conductive member 80 may be position to cooperate and make contact with the recess 96 of connector body 90 and the outer internal wall 39 of an operably attached threaded nut 30 of an embodiment of a connector 100. Those in the art should recognize that embodiments of the connector 100 may employ both the mating edge conductive member 70 and the connector body conductive member 80 in a single connector 100. Accordingly the various advantages attributable to each of the mating edge conductive member 70 and the connector body conductive member 80 may be obtained.

A method for grounding a coaxial cable 10 through a connector 100 is now described with reference to FIG. 1 which depicts a sectional side view of an embodiment of a connector 100. A coaxial cable 10 may be prepared for connector 100 attachment. Preparation of the coaxial cable 10 may involve removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. Various other preparatory configurations of coaxial cable 10 may be employed for use with connector 100 in accordance with standard broadband communications technology and equipment. For example, the coaxial cable may be prepared without drawing back the conductive grounding shield 14, but merely stripping a portion thereof to expose the interior dielectric 16.

With continued reference to FIG. 1 and additional reference to FIG. 7, further depiction of a method for grounding a coaxial cable 10 through a connector 100 is described. A connector 100 including a post 40 having a first end 42 and second end 44 may be provided. Moreover, the provided connector may include a connector body 50 and a mating edge conductive member 70 located proximate the second end 44 of post 40. The proximate location of the mating edge conductive member 70 should be such that the mating edge conductive member 70 makes physical and electrical contact with post 40. In one embodiment, the mating edge conductive member or O-ring 70 may be inserted into a threaded nut 30 until it abuts the mating edge 49 of post 40. However, other embodiments of connector 100 may locate the mating edge conductive member 70 at or very near the second end 44 of post 40 without insertion of the mating edge conductive member 70 into a threaded nut 30.

Grounding may be further attained by fixedly attaching the coaxial cable 10 to the connector 100. Attachment may be accomplished by insetting the coaxial cable 10 into the connector 100 such that the first end 42 of post 40 is inserted under the conductive grounding sheath or shield 14 and around the dielectric 16. Where the post 40 is comprised of conductive material, a grounding connection may be achieved between the received conductive grounding shield 14 of coaxial cable 10 and the inserted post 40. The ground may extend through the post 40 from the first end 42 where initial physical and electrical contact is made with the conductive grounding sheath 14 to the mating edge 49 located at the second end 44 of the post 40. Once, received, the coaxial cable 10 may be securely fixed into position by radially compressing the outer surface 57 of connector body 50 against the coaxial cable 10 thereby affixing the cable into position and sealing the connection. The radial compression of the connector body 50 may be effectuated by physical deformation caused by a fastener member 60 that may compress and lock the connector body 50 into place. Moreover, where the connector body 50 is formed of materials having and elastic limit, compression may be accomplished by crimping tools, or other like means that may be implemented to permanently deform the connector body 50 into a securely affixed position around the coaxial cable 10.

As an additional step, grounding of the coaxial cable 10 through the connector 100 may be accomplished by advancing the connector 100 onto an interface port 20 until a surface of the interface port mates with the mating edge conductive member 70. Because the mating edge conductive member 70 is located such that it makes physical and electrical contact with post 40, grounding may be extended from the post 40 through the mating edge conductive member 70 and then through the mated interface port 20. Accordingly, the interface port 20 should make physical and electrical contact with the mating edge conductive member 70. The mating edge conductive member 70 may function as a conductive seal when physically pressed against the interface port 20. Advancement of the connector 100 onto the interface port 20 may involve the threading on of attached threaded nut 30 of connector 100 until a surface of the interface port 20 abuts the mating edge conductive member 70 and axial progression of the advancing connector 100 is hindered by the abutment. However, it should be recognized that embodiments of the connector 100 may be advanced onto an interface port 20 without threading and involvement of a threaded nut 30. Once advanced until progression is stopped by the conductive sealing contact of mating edge conductive member 70 with interface port 20, the connector 100 may be shielded from ingress of unwanted electromagnetic interference. Moreover, grounding may be accomplished by physical advancement of various embodiments of the connector 100 wherein a mating edge conductive member 70 facilitates electrical connection of the connector 100 and attached coaxial cable 10 to an interface port 20.

A method for electrically coupling a connector 100 and a coaxial cable 10 is now described with reference to FIG. 1. A coaxial cable 10 may be prepared for fastening to connector 100. Preparation of the coaxial cable 10 may involve removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18.

With continued reference to FIG. 1 and additional reference to FIG. 8, further depiction of a method for electrically coupling a coaxial cable 10 and a connector 100 is described. A connector 100 including a connector body 50 and a threaded nut 30 may be provided. Moreover, the provided connector may include a connector body conductive member or seal 80. The connector body conductive member or seal 80 should be configured and located such that the connector body conductive member 80 electrically couples and physically seals the connector body 50 and threaded nut 30. In one embodiment, the connector body conductive member or seal 80 may be located proximate a second end 54 of a connector body 50. The connector body conductive member 80 may reside within a cavity 38 of threaded nut 30 such that the connector body conductive member 80 lies between the connector body 50 and threaded nut 30 when attached. Furthermore, the particularly embodied connector body conductive member 80 may physically contact and make a seal with outer internal wall 39 of threaded nut 30. Moreover, the connector body conductive member 80 may physically contact and seal against the surface of connector body 50. Accordingly, where the connector body 50 is comprised of conductive material and the threaded nut 30 is comprised of conductive material, the connector body conductive member 80 may electrically couple the connector body 50 and the threaded nut 30. Various other embodiments of connector 100 may incorporate a connector body conductive member 80 for the purpose of electrically coupling a coaxial cable 10 and connector 100. For example, the connector body conductive member, such as O-ring 80, may be located in a recess on the outer surface of the threaded nut 30 such that the connector body conductive O-ring 80 lies between the nut and an internal surface of connector body 50, thereby facilitating a physical seal and electrical couple.

Electrical coupling may be further accomplished by fixedly attaching the coaxial cable 10 to the connector 100. The coaxial cable 10 may be inserted into the connector body 50 such that the conductive grounding shield 14 makes physical and electrical contact with and is received by the connector body 50. In one embodiment of the connector 100, the drawn back conductive grounding shield 14 may be pushed against the inner surface of the connector body 50 when inserted. Once received, or operably inserted into the connector 100, the coaxial cable 10 may be securely set into position by compacting and deforming the outer surface 57 of connector body 50 against the coaxial cable 10 thereby affixing the cable into position and sealing the connection. Compaction and deformation of the connector body 50 may be effectuated by physical compression caused by a fastener member 60, wherein the fastener member 60 constricts and locks the connector body 50 into place. Moreover, where the connector body 50 is formed of materials having and elastic limit, compaction and deformation may be accomplished by crimping tools, or other like means that may be implemented to permanently contort the outer surface 57 of connector body 50 into a securely affixed position around the coaxial cable 10.

A further method step of electrically coupling the coaxial cable 10 and the connector 100 may be accomplished by completing an electromagnetic shield by threading the threaded nut 30 onto a conductive interface port 20. Where the connector body 50 and threaded nut 30 are formed of conductive materials, an electrical circuit may be formed when the conductive interface port 20 contacts the threaded nut 30 because the connector body conductive member 80 extends the electrical circuit and facilitates electrical contact between the threaded nut 30 and connector body 50. Moreover, the realized electrical circuit works in conjunction with physical screening performed by the connector body 50 and threaded nut 30 as positioned in barrier-like fashion around a coaxial cable 10 when fixedly attached to a connector 100 to complete an electromagnetic shield where the connector body conductive member 80 also operates to physically screen electromagnetic noise. Thus, when threaded onto an interface port 20, the completed electrical couple renders electromagnetic protection, or EMI shielding, against unwanted ingress of environmental noise into the connector 100 and coaxial cable 10.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A connector for coupling an end of a coaxial cable and for facilitating electrical connection with a male coaxial cable interface port, the coaxial cable having a center conductor surrounded by a dielectric, the dielectric being surrounded by a conductive grounding shield, the conductive grounding shield being surrounded by a protective outer jacket, the connector comprising:

a connector body, configured to receive at least a portion of the coaxial cable;

a post, having a mating edge, the post configured to electrically contact the conductive grounding shield of the coaxial cable; and a conductive member, configured to reside within a threaded nut of the connector, the conductive member positioned to physically and electrically contact the mating edge of the post to facilitate grounding of the connector through the conductive member and the post to the cable when the connector is threadably advanced onto an interface port and to help shield against ingress of unwanted electromagnetic interference.

2. The connector of claim 1, wherein said post includes a first end and a second end, the first end configured to be inserted into the end of the coaxial cable around the dielectric and under the conductive grounding shield thereof, and the second end having a face including the mating edge.

3. The connector of claim 1, wherein the conductive member is a conductive O-ring for conductively sealing and physically sealing the connector.

4. The connector of claim 1, wherein the connector body includes a first end and a second end, said first end configured to deformably compress against and seal a received coaxial cable.

5. The connector of claim 4, further including a fastener member, wherein the fastener member is sized and shaped to deform the first end of said connector body.

6. A connector for coupling an end of a coaxial cable and facilitating electrical connection with a male coaxial cable interface port, the coaxial cable having a center conductor surrounded by a dielectric, the dielectric being surrounded by a conductive grounding shield, the conductive grounding shield being surrounded by a protective outer jacket, the connector comprising:

a post having a mating edge, wherein at least a portion of the post resides within a connector body;

a threaded nut positioned axially with respect to the post; and means for conductively sealing and electrically coupling the post and the threaded nut of the connector to help facilitate grounding of the connector, wherein the means for conductively sealing and electrically coupling physically and electrically contact the mating edge of the post.

7. A method for grounding a coaxial cable through a connector, the coaxial cable having a center conductor surrounded by a dielectric, the dielectric being surrounded by a conductive grounding shield, the conductive grounding shield being surrounded by a protective outer jacket, the method comprising:

providing a connector, wherein the connector includes a connector body, a post having a mating edge, and a conductive member positioned to physically and electrically contact the mating edge of the post to facilitate grounding of the connector through the conductive member and the post to the cable, when the connector is attached to an interface port;

fixedly attaching the coaxial cable to the connector; and advancing the connector onto an interface port until electrical grounding is extended through the conductive member.

8. The method of claim 7, further including providing said connector, wherein said connector further includes a threaded nut, and further wherein the conductive member electrically couples and physically seals the post and threaded nut.

9. The method of claim 8, further including completing an electromagnetic shield by threading the nut onto the interface port.

* * * * *